US008704074B1

(12) United States Patent
Liu

(10) Patent No.: US 8,704,074 B1
(45) Date of Patent: Apr. 22, 2014

(54) PICKUP SYSTEM FOR STRINGED MUSICAL INSTRUMENTS COMPRISES OF NON-HUMBUCKING PICKUPS WITH NOISE CANCELLING BY CURRENT INJECTION

(76) Inventor: Yungman Alan Liu, Sunnyvale, CA (US)

( * ) Notice: Subject to any disclaimer, the term of this patent is extended or adjusted under 35 U.S.C. 154(b) by 0 days.

(21) Appl. No.: 13/533,932

(22) Filed: Jun. 26, 2012

(51) Int. Cl.
*G10H 3/18* (2006.01)

(52) U.S. Cl.
USPC ..... 84/728

(58) Field of Classification Search
USPC ..... 84/726–728
See application file for complete search history.

(56) References Cited

U.S. PATENT DOCUMENTS

| | | | | |
|---|---|---|---|---|
| 4,878,412 | A * | 11/1989 | Resnick | 84/726 |
| 5,569,872 | A * | 10/1996 | Gimpel | 84/728 |
| 5,932,827 | A * | 8/1999 | Osborne et al. | 84/726 |
| 6,208,135 | B1 * | 3/2001 | Shattil | 324/225 |
| 7,166,793 | B2 * | 1/2007 | Beller | 84/723 |
| 2002/0069749 | A1 * | 6/2002 | Hoover et al. | 84/738 |

* cited by examiner

*Primary Examiner* — Jeffrey Donels

(57) ABSTRACT

This embodiment is a noise cancellation system for electric stringed instrument comprises of passive pickup circuit with non humbucking pickup coils called a signal coil. Each signal coil senses the unwanted electromagnetic radiation from the surrounding and produce a noise voltage that gives humming and buzzing noise through an amplifier. This embodiment cancels the noise by injecting a current signal directly into the signal coil. The impedance of the signal coil in parallel with the impedance already loading the signal coil, transform the current signal back to a voltage equal and opposite to the noise voltage; thereby, canceling each other and eliminates the noise.

17 Claims, 10 Drawing Sheets

PICKUP SYSTEM FOR STRINGED MUSICAL INSTRUMENTS COMPRISES OF NON-HUMBUCKING PICKUPS WITH NOISE CANCELLING BY CURRENT INJECTION

FIELD OF INVENTION

This Embodiment is a noise cancellation system for electric stringed instruments comprises a pickup circuit with pickup coils.

BACKGROUND OF INVENTION

Figure 1A:
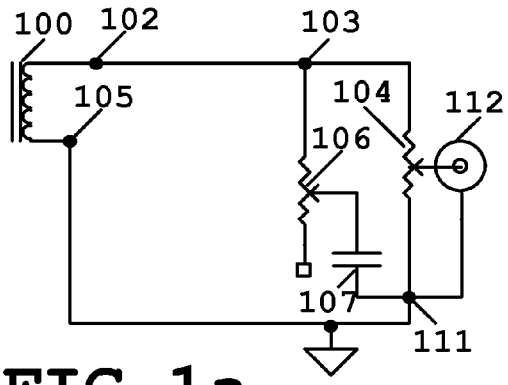
FIG.1a PRIOR ART

FIG. 1*a* is a simplified passive pickup circuit found in most of the electric stringed musical instruments. The pickup circuit is called a Strings Sensing Means in this embodiment, it comprises of a non-humbucking pickup coil named Signal Coil. Most electric stringed instruments comprise of a passive Strings Sensing Means with a single of plurality of Signal Coils. But the basic theory is similar to the circuit shown in FIG. 1*a*. In FIG. 1*a*, Coil 100 senses the vibrating strings and the unwanted electromagnetic radiation from the surrounding; thereby, producing a Signal Voltage and a Noise Voltage. The Noise Voltage produces humming or buzzing sound when connected to an amplifier. Sound characteristics produced by coil 100 is affected by the impedance loading coil 100. FIG. 1*a* comprises a Sound Control circuit that control the volume and the tone of the stringed instrument. The Sound Control circuit also serves as load across coil 100 to produce the most desirable sound characteristics. In this embodiment, the Sound Control circuit is also called Optimal Load. The most common form of Optimal Load is implemented with a potentiometer (pot) 104 in parallel with a tone circuit between junction 103 and 111. The tone circuit comprises pot 106 and capacitor 107. For Fender Stratocaster type Signal Coils, it was found that 250KΩ for pot 104, 106 and 0.022 μF for capacitor 107 produce the best sound characteristics. At frequency above 500 Hz, the reactance of the capacitor 107 is much lower than 250KΩ. Thereby, the Optimal Load for Fender types of Signal Coils is the parallel of the pot 104 and 106, which is 125KΩ. For Gibson with P90 type of Signal Coils, people find 500KΩ for pot 104 and 106 produces the best sound characteristics. Thereby the Optimal Load is 250KΩ.

Referring back to FIG. 1*a*, any active electronics such as transistor and op-amp in either the signal forward or return path in the passive pickup circuit alters the sound characteristics. The signal forward path is from coil 100 at junction 102 to 103, through potentiometer 104 to Output Jack 112. The signal forward path also goes from junction 103 through potentiometer 106 and capacitor 107 to junction 111. The signal return path is from the ground of Output Jack 316, through junction 111 to junction 107, back to the return of the Signal Coil 100 at junction 105. This Embodiment uses active circuit for noise cancellation while keeping the both signal forward and return path unchanged and totally passive. Noise cancellation of this Embodiment is by injection of a current signal directly into the Signal Coil using a Transconductance Means called Injection Amp. The Injection Amp is designed to inject the Current Signal directly into the Signal Coil without affecting the original sound characteristics. This eliminates the need of adding any active circuit in the signal forward and return path inside the passive Strings Sensing Means of the stringed instrument.

Prior Arts Using Passive Noise Cancelling

Figure 1B:
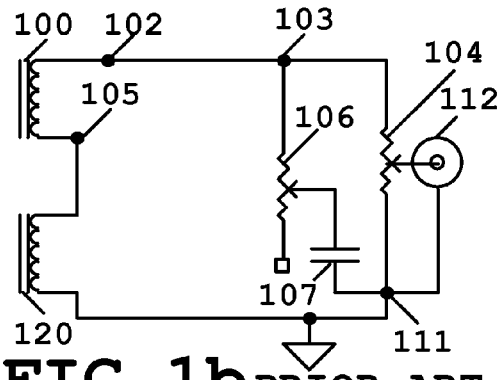
FIG.1b PRIOR ART

Three prior designs are described here shown in FIG. 1*b*. Same alpha numeric for the same components and wires are used as in FIG. 1*a*. In FIG. 1*b*, coil 100 produces a Signal and a Noise Voltage. A Cancellation Coil 120, is designed to detect only the unwanted electromagnetic radiation and produces a Cancellation Voltage with the same amplitude but opposite phase to the Noise Voltage. Since both coil 100 and 120 are connected in series, the Cancellation Voltage cancels the Noise Voltage. The problem in this design is, coil 120 acts as a filter, which changes the sound produced by Signal Coil 100. Three examples using this concept are:

1) Fender Powerhouse Stratocaster that uses a coil 120 placed far away from the strings to sense the unwanted electromagnetic radiation only.
2) U.S. Pat. No. 4,442,749 by Lawrence Dimarzio where coil 120 is located right under Coil 100.
3) U.S. Pat. No. 7,259,318B by Chiliachki where coil 120 has a large area in the middle. The larger the area, the less turns is needed, whereby, less filtering of the sound of coil 100.

Prior Arts Using Active Noise Cancelling

Referring back to the description of FIG. 1*a*, any active electronics such as transistor and op-amp in either the signal forward or return path in the passive pickup circuit alters the sound characteristics.

1) One prior design is represented by U.S. Pat. No. 4,581,974 filed by Leo Fender. The simplified circuit is shown in FIG. 1*a*. Coil 100 produces the Signal and Noise Voltage; and the coil 120 produces only the Cancellation Voltage. The two outputs are summed together and Noise Voltage is cancelled by a summing amplifier 50 using resistors 51, 52 and 53. The summing amplifier isolates coil 120 from affecting coil 100. The Signal Voltage from coil 100 goes through op-amp 50. Since there is active electronics in the signal path, it changes the sound of the otherwise passive circuit. Also the instrument will stop functioning if the battery runs out. This is a problem if this happens during the performance.
2) Another design using active electronics is U.S. Pat. No. 5,569,872 by Dudley Gimpel. The simplified circuit is shown in FIG. 2*b*. The concept is similar to the circuit shown in FIG. 1*b* except using an amplifier 208 to isolate Signal Coil 100 from Cancellation Coil 120. The idea is using the output of amplifier 208 to provide a low impedance return path for coil 100. As shown in FIG. 2*b*, the signal forward path is from junction 214 through junction 103 and potentiometer 104 to output jack 112. The forward path contains only passive components like in FIG. 1*a*. This is an improvement over the one by Leo Fender. However, the signal return path from junction 111 goes through the isolation amplifier 208 and capacitor 211 back to the bottom of coil 100. Thereby, the signal return path contains active electronics. Although the isolation amplifier 208 has low output impedance, still, this is not a true ground. Furthermore, if the battery runs out, amplifier 208 turns off; and the low impedance return path for coil 100 is lost.
3) Another design using active noise canceling is U.S. Pat. No. 6,208,135 B1 by Steve J. Shattil. In U.S. Pat. No. 6,208,135 B1, only FIG. 1 and FIG. 2. are very similar to the U.S. Pat. No. 4,581,974 described above. The other aspects involve an Antenna to generate an electromagnetic wave in the region around the Signal Coil to cancel the unwanted electromagnetic radiation. The signal used to drive the Antenna coil also comprises of signals of the vibrating strings, this will definitely change the sound of the instrument. This is more suitable to product positive feedback to sustain the sound of the stringed instrument to make it sound like a violin than for noise cancellation.

SUMMARY

This Embodiment is a pickup system with noise cancellation for electric stringed instruments with String Sensing Means comprise a single or plurality of pickup coils called Signal Coils. Noise Voltage that causes humming and buzzing noise when connect to an amplifier. This Embodiment comprises:

a) A Strings Sensing Means from the existing stringed instrument.

b) A Hum Cancellation Means, wherein:

i) A Means of Noise Sensing that senses only the said unwanted electromagnetic radiation.

ii) A single or plurality of Transconductance Means called Injection Amp with high output impedance. Each transforms the output of the said Means of Noise Sensing into a Current Signal, then injects each of the Current Signal directly into one of the Signal Coil.

c) A single or plurality of Transimpedance Means, each comprises one of the Signal Coil in parallel with the Optimal Load for that Signal Coil inside the Strings Sensing Means of the stringed instrument. Each Transimpedance Means transforms a Current Signal back to a voltage equal and opposite to the Noise Voltage of the said Signal Coil; whereby, canceling each other and eliminates the noise.

The Injection Amp is designed with output impedance as high as practical. It is limited by the voltage of the power source used for this embodiment, and the complexity of the Injection Amp 304. High output impedance of the Injection Amp will present negligible extra loading when connected directly to the Signal Coil. In practice, the output impedance of the Injection Amp should be at least 5 times the impedance of the Optimal Load for the Signal Coil. This result in less than 17% decrease of the impedance loading the Signal Coil. Further lowering the output impedance will definitely have noticeable affect on the sound characteristics, experiment has to be done to see whether it is acceptable.

Advantage of this Embodiment

1) The extra steps of using a Current Signal for noise cancellation enables the use of a simple Injection Amp with adjustable output impedance. This allows direct connection of the Injection Amp to the Signal Coil with negligible affect of the loading of the Signal Coil. This avoids adding active circuit inside the high impedance signal path of the passive pickup circuit. Active circuit is needed in order to interface with any other noise cancellation circuit with low output impedance as in the prior inventions. Pickup circuit using this Embodiment remains totally passive and preserves the original sound characteristics of the stringed instrument.

2) The Injection Amp have the similar output impedance with or without electrical power. Whereby, the said stringed instrument using this Embodiment, can function and produces the same sound characteristics with or without power. Users do not have to worry that the battery running out in the middle of the performance.

3) No modification is needed to the original pickup circuit of the stringed instrument. This make it easier to retrofit into an existing electrical stringed instrument. This is particularly important for instrument that has collectable value.

DRAWING DESCRIPTIONS

Alpha Numerals of the same functional blocks, components, wires and junctions are labeled the same in different figures. Function blocks are labeled by alpha numeric numbered with under score.

FIG. 1*a* Simplified circuit of a conventional non-humbucking pickup system.

FIG. 1*b* Prior arts of passive noise cancelling using a cancellation coil.

Figure 2A:
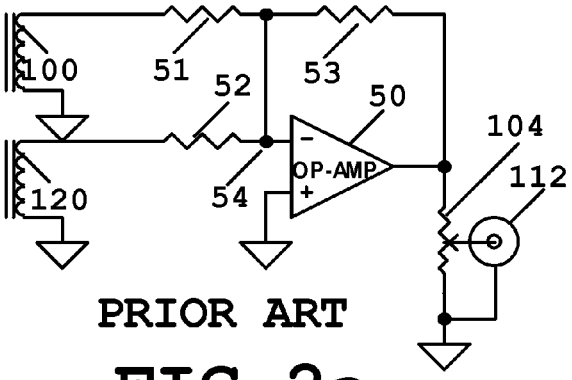
PRIOR ART FIG.2a
Figure 2B:
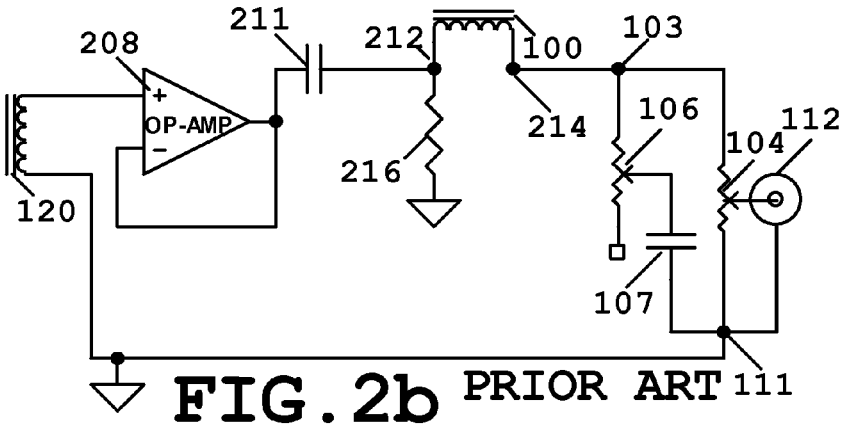
FIG.2b PRIOR ART

FIG. 2*a* Prior art of noise cancelling using active circuits with virtual ground summing amplifier.

FIG. 1*b* Prior art of noise cancelling using active low impedance isolation amplifier.

Figure 3A:
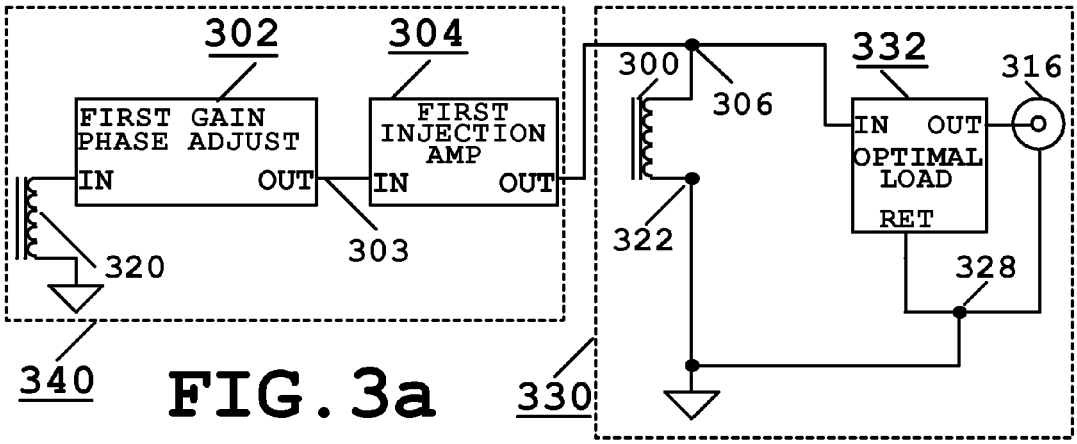

FIG. 3*a* Function block representation of First Aspect of this Embodiment.

Figure 3B:
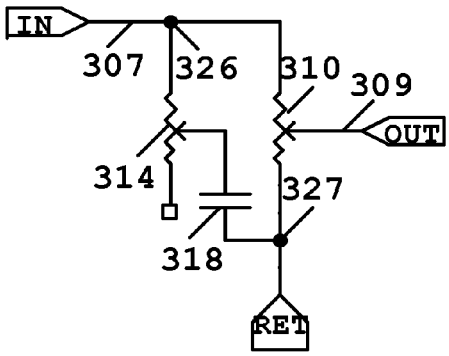

FIG. 3*b* Sound Control circuit also called Optimal Load, typically comprises of a volume control and a tone control circuit.

Figure 3C:
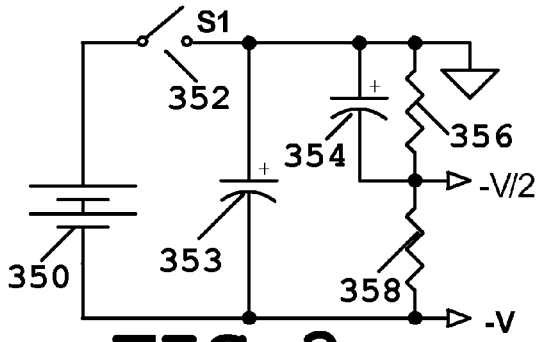

FIG. 3*c* Battery circuit that power all different aspects of this Embodiment.

Figure 4A:
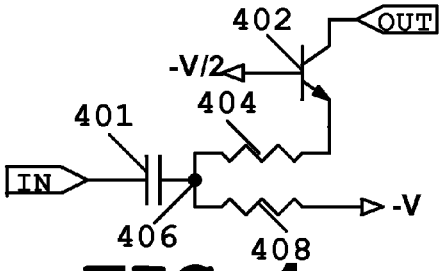

FIG. 4*a* First implementation of Injection Amp.

Figure 4B:
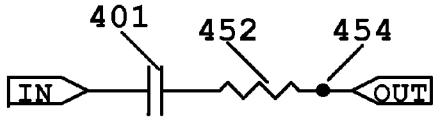

FIG. 4*b* Second implementation of Injection Amp, using an Impedance Means.

Figure 4C:
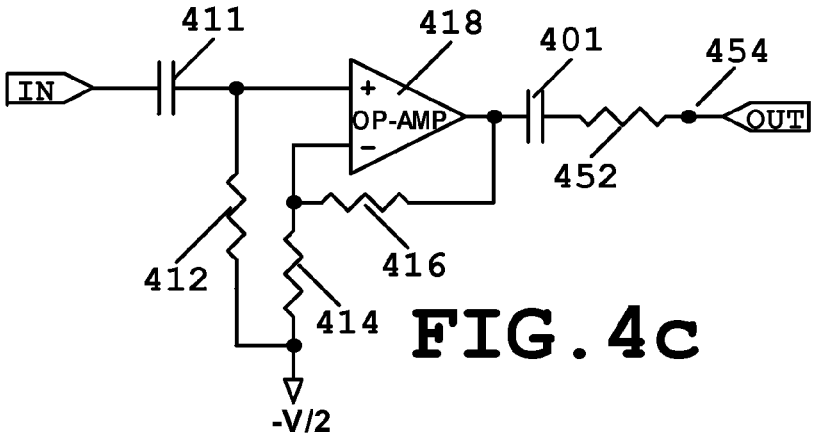

FIG. 4*c* Third implementation of Injection Amp with one gain stage and Impedance Means.

Figure 5A:
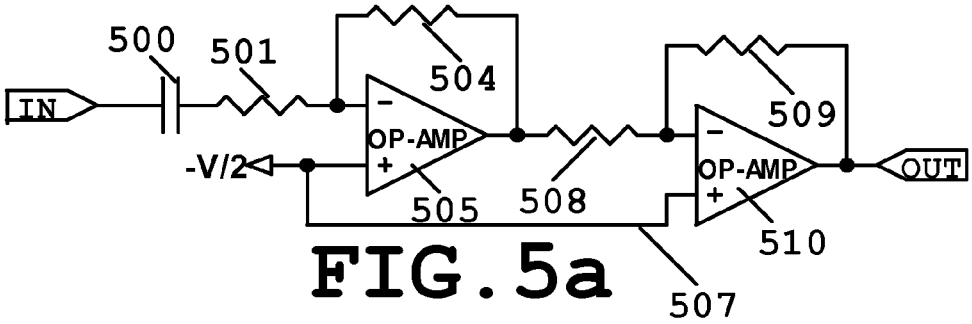

FIG. 5*a* First implementation of Gain Phase Adjust circuit.

Figure 5B:
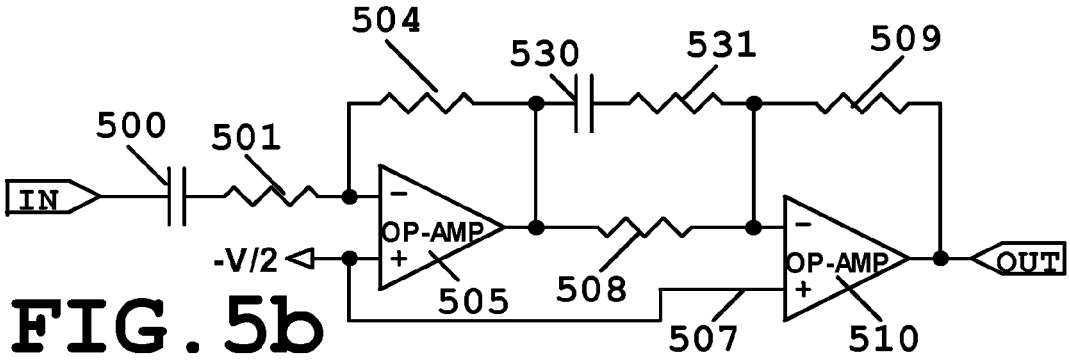

FIG. 5*b* Second implementation of Gain Phase Adjust circuit.

Figure 5C:
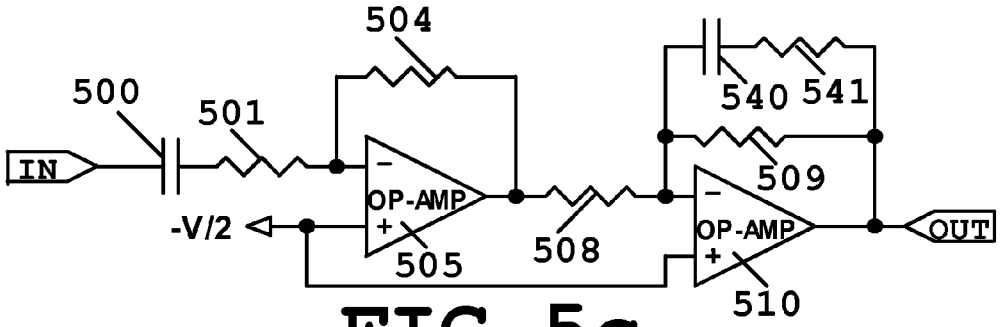

FIG. 5*c* Third implementation of Gain Phase Adjust circuit.

Figure 5D:
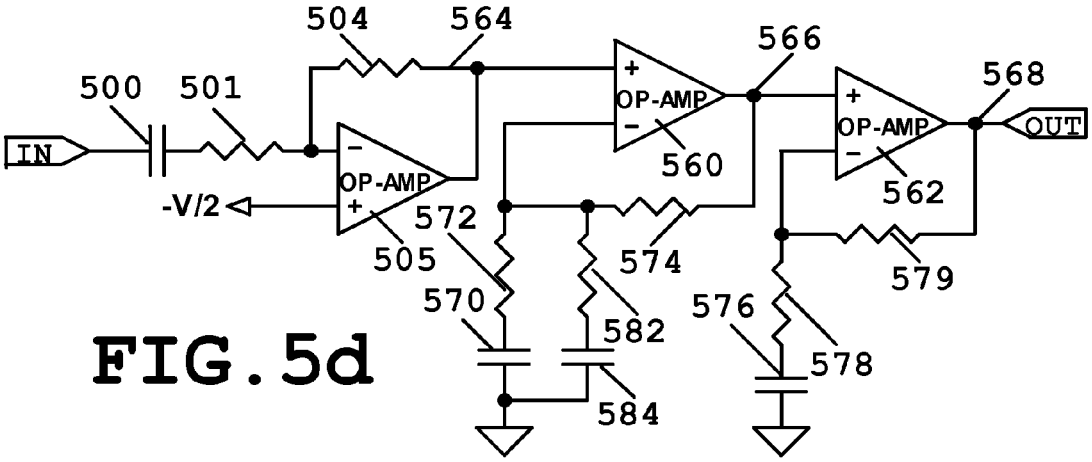

FIG. 5*d* Fourth implementation of Gain Phase Adjust circuit.

Figure 6A:
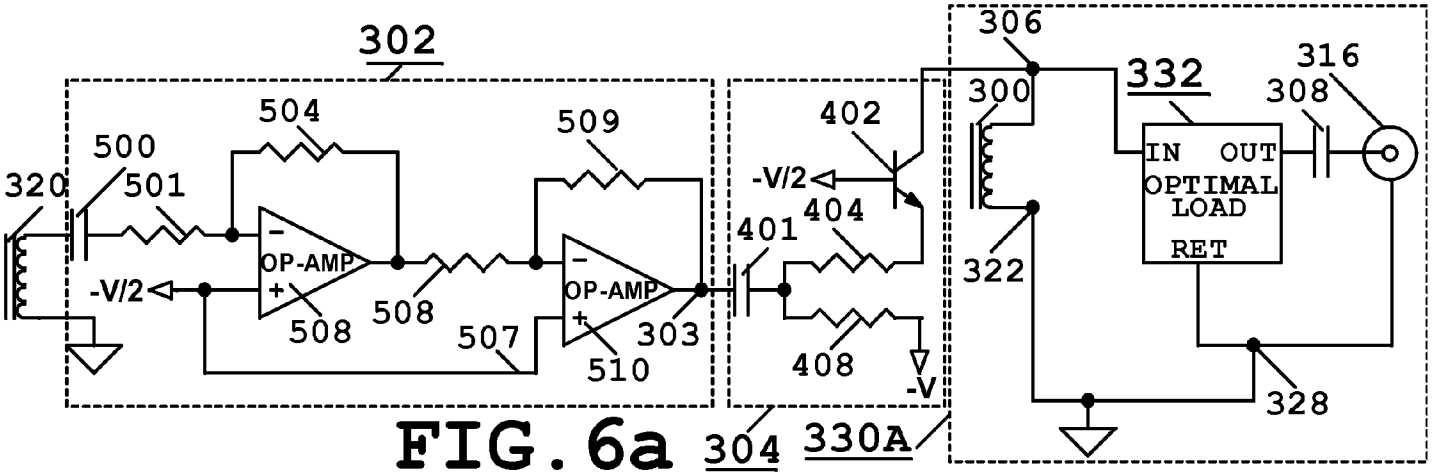

FIG. 6*a* First circuit implementation of the First Aspect of this Embodiment shown in FIG. 3*a*.

Figure 6B:
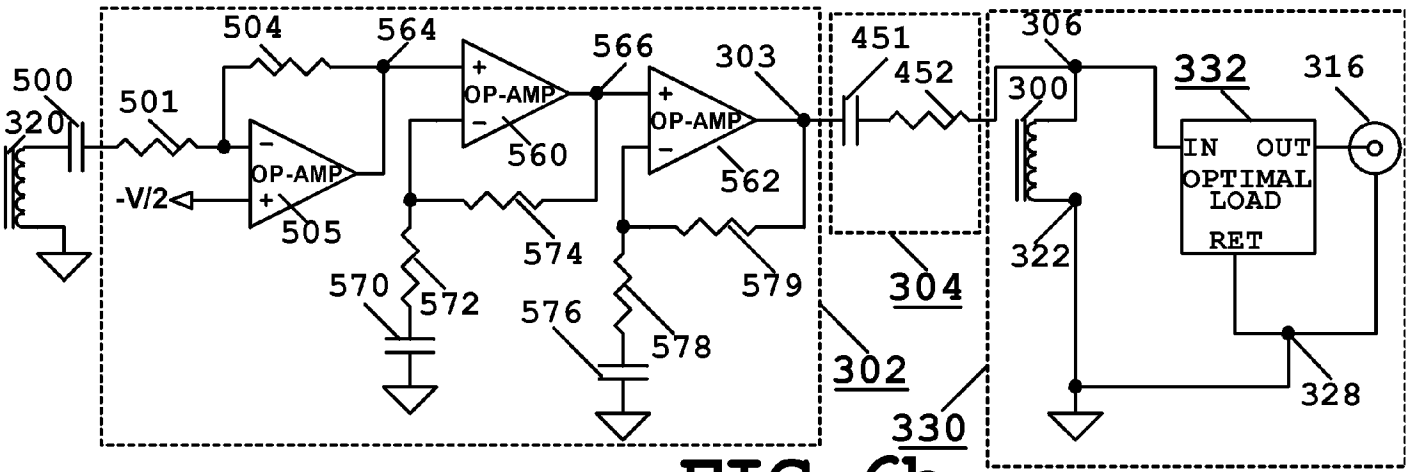

FIG. 6*b* Second circuit implementation of the First Aspect of this Embodiment shown in FIG. 3*a*.

Figure 7A:
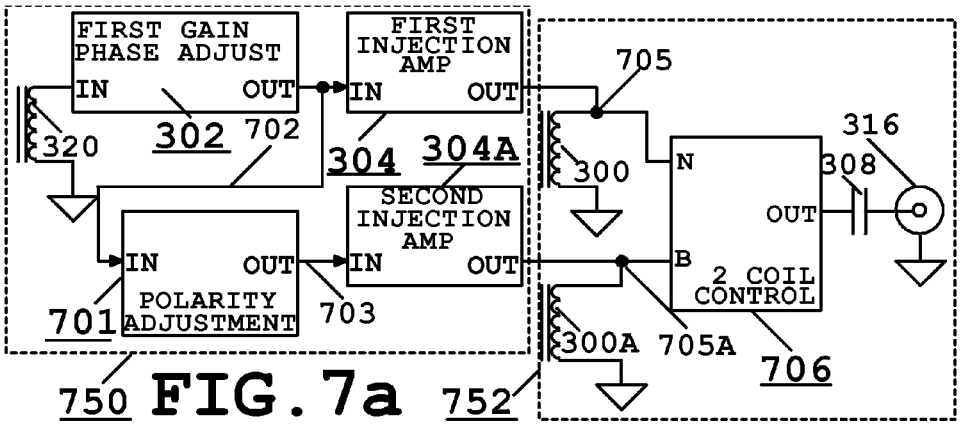

FIG. 7*a* Function block of Second Aspect of this Embodiment comprises of two Signal Coils.

Figure 7B:
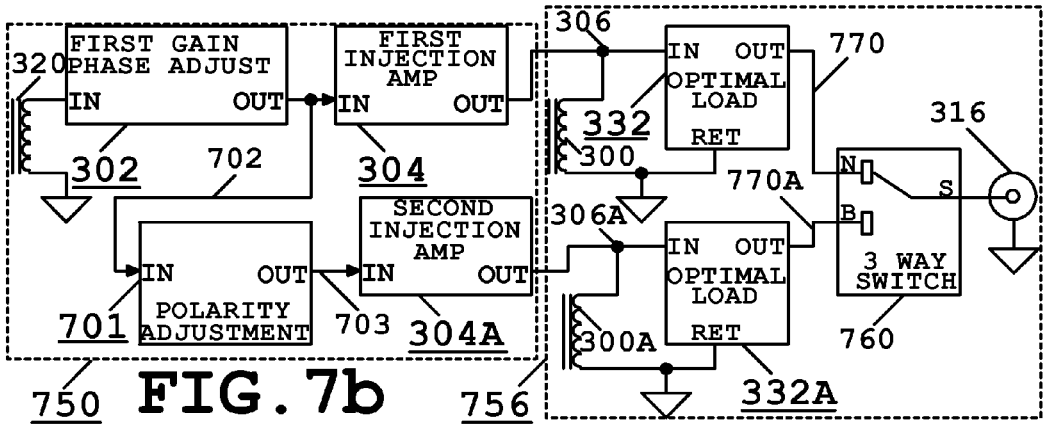

FIG. 7*b* Function block of Third Aspect of this Embodiment comprises of two Signal Coils.

Figure 7C:
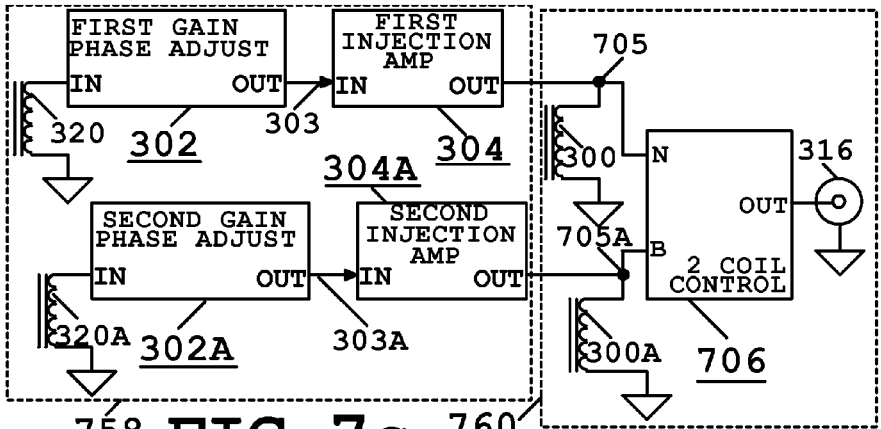

FIG. 7*c* Function block of Fourth Aspect of this Embodiment comprises of two Signal Coils.

Figure 7D:
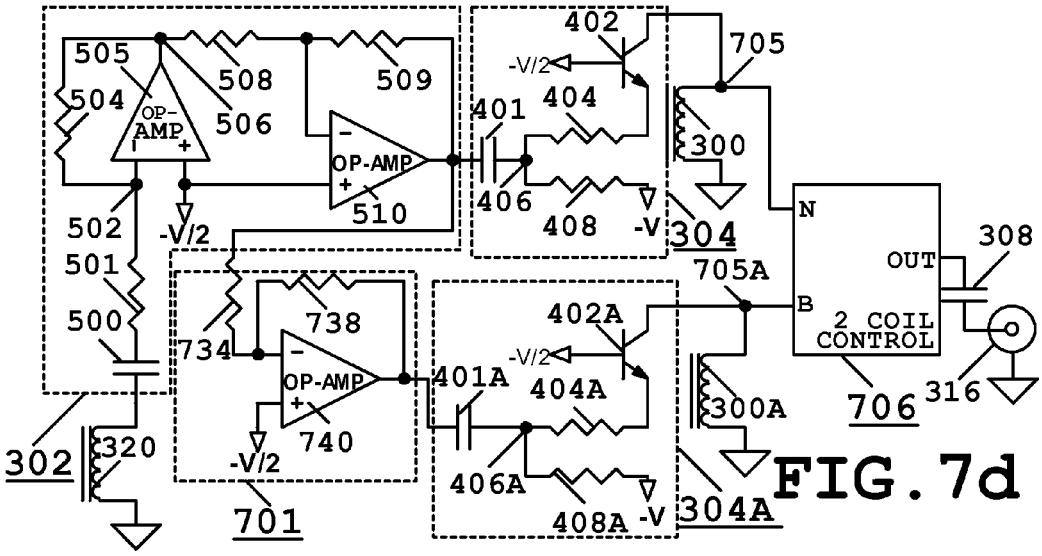

FIG. 7*d* Circuit implementation of the Second Aspect of this Embodiment shown in FIG. 7*a*.

Figure 7E:
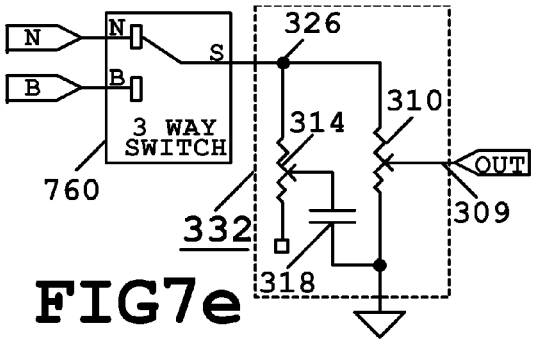

FIG. 7*e* 2 coil control functional block with 3 Way Select Switch and Optimal Load.

Figure 7F:
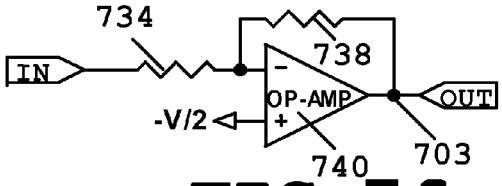

FIG. 7*f* First Aspect of Polarity control functional block that inverts the signal.

Figure 7G:
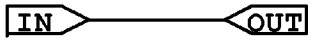

FIG. 7*g* Second Aspect of Polarity control functional block that is a straight pass.

Figure 8A:
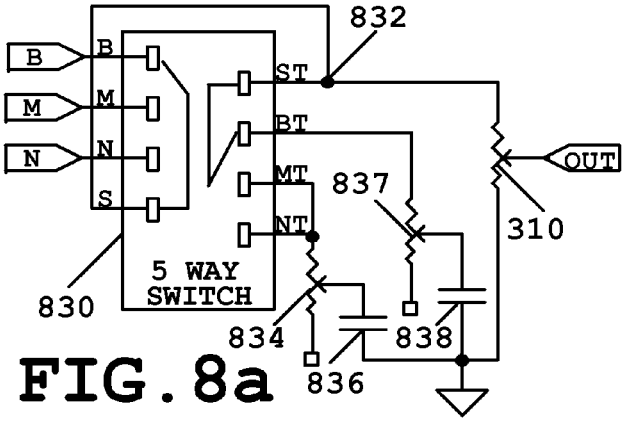

FIG. 8*a* 3 Coil Control functional block.

Figure 8B:
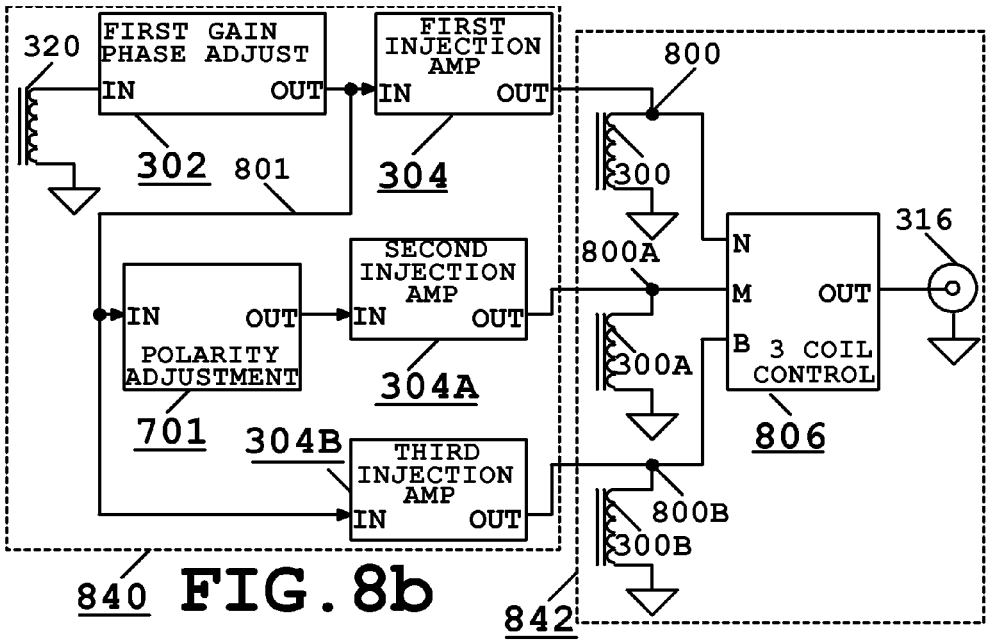

FIG. 8*b* Function block of the Fifth Aspect of this Embodiment, comprises of three Signal Coils.

Figure 8C:
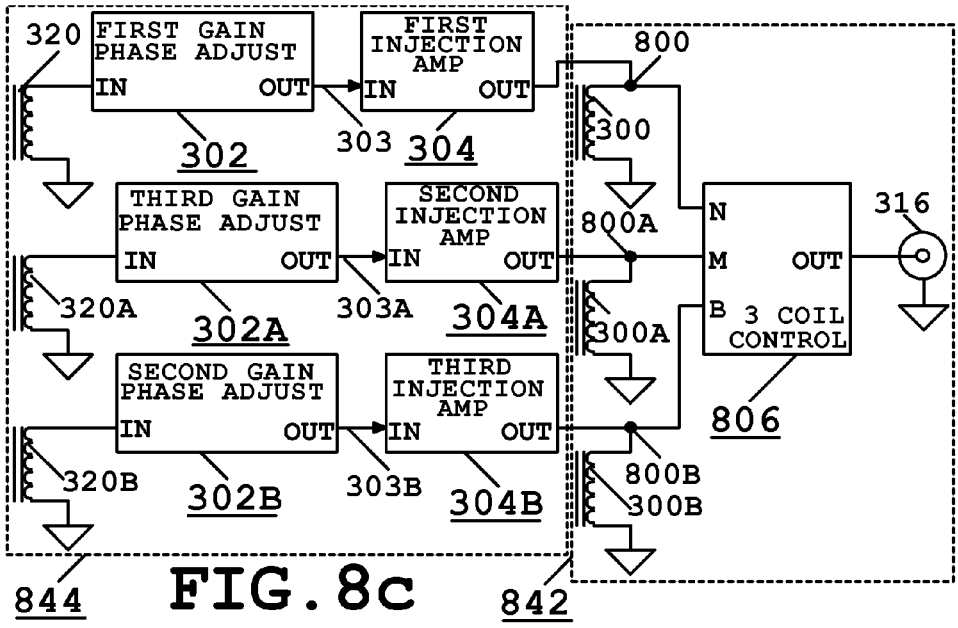

FIG. 8*c* Function block of the Sixth aspect of this Embodiment, comprises of three Signal Coils.

Figure 8D:
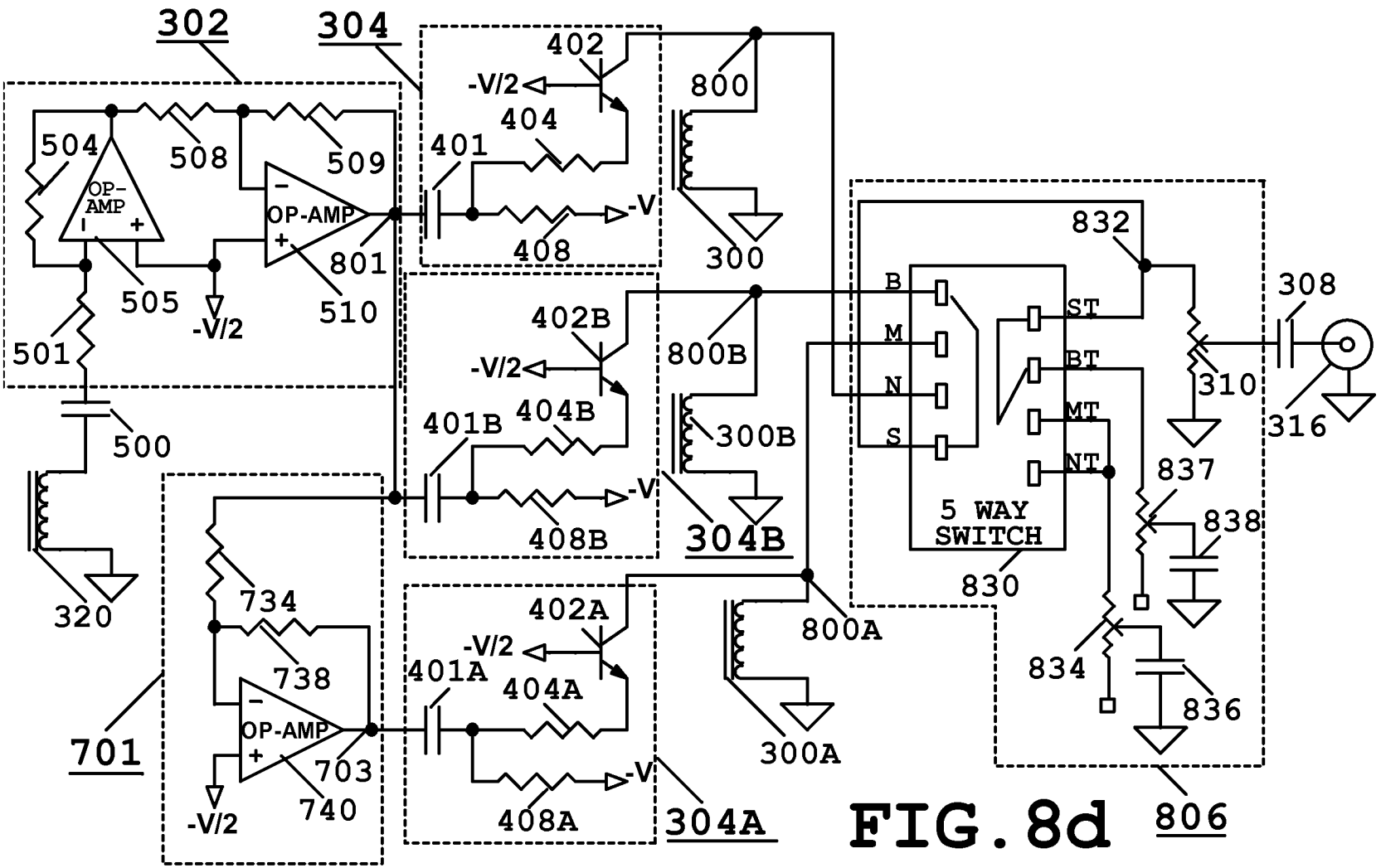

FIG. 8*d* First circuit implementation of the Fifth Aspect of this Embodiment shown in FIG. 8*b*.

Figure 8E:
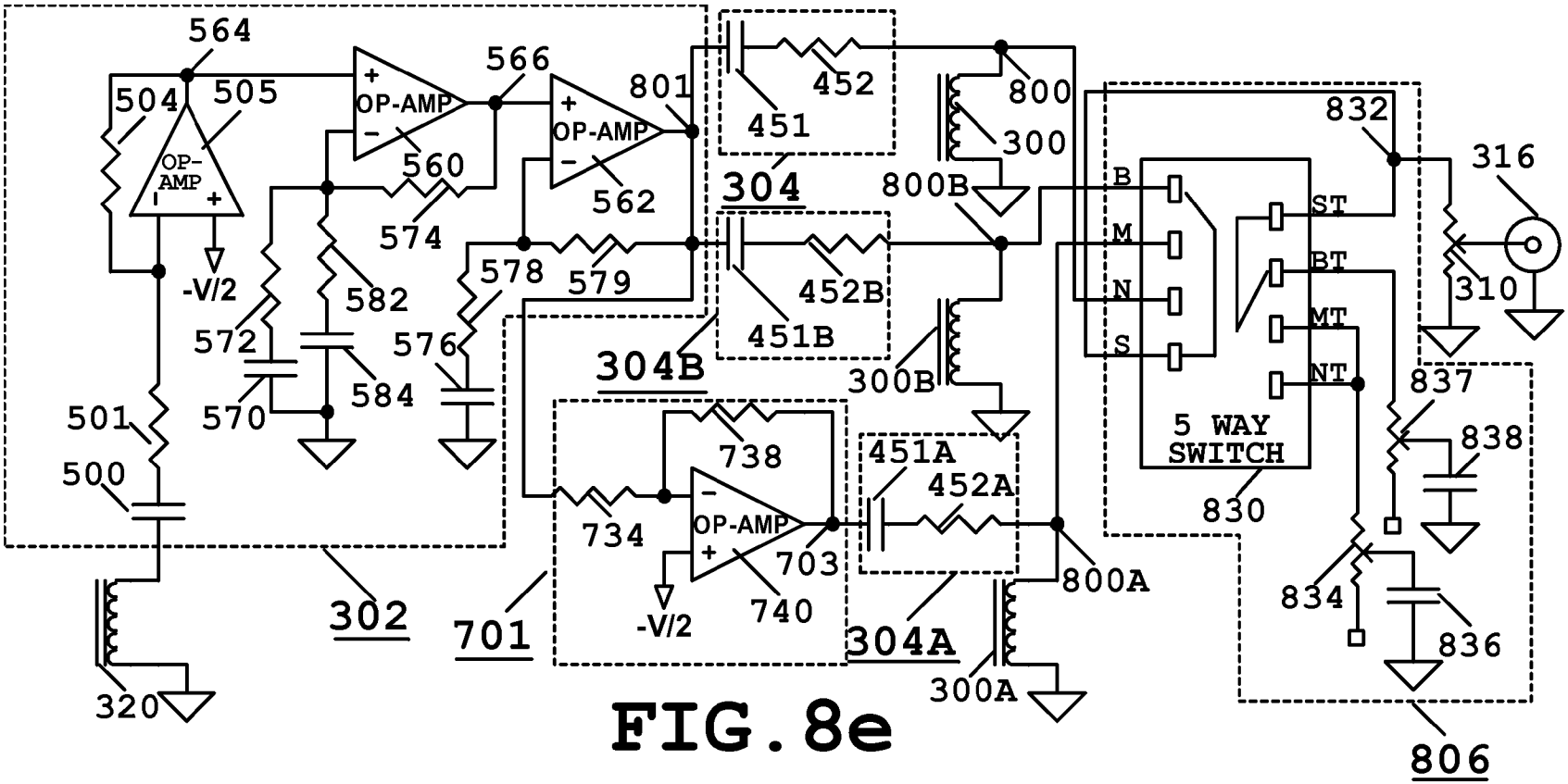

FIG. 8*e* Second circuit implementation of the Fifth Aspect of this Embodiment shown in FIG. 8*b*.

DETAIL DESCRIPTION

The functional blocks used in this Embodiment are described first. Operational amplifier and transistor used are but not limited to MC33179 and MPSA18 respectively.

Function Blocks Used in this Embodiment:

1) Sound Control circuit, also called Optimal Load 332 shown in FIG. 3*b*, The Optimal Load is used for controlling the sound and for loading the Signal Coil. It is the same as described in FIG. 1*a*. Other implementations of Optimal Load that can present the optimal impedance loading the Signal Coil can also be used. Optimal Load 332 in FIG. 3*b* comprises of a pot 310 in parallel with a tone circuit between junction 326 and 327. Tone circuit comprises of pot 314 and capacitor 318. See description in the Background section before.

2) Gain Phase Adjust functional blocks 302, 302A and 302B are either comprises of amplifiers or amplifiers with simple low pass and high pass filters. The filters are used to adjust the amplitude and phase of the Cancellation Voltages from the coils 320, 320A and 320B. Four different designs are shown in FIG. 5. This kind of circuit can be found in text books, anyone skill in the art can design this kind of circuit. The pole and zero of the high pass and low pass filters are found by experiment rather than using calculation. They depend on the type of Signal Coil and Cancellation Coil used. The value given here are just the values to get the best cancellation for specific Signal and Cancellation Coil used. They serve as the starting point and need to be modified to get best result. Trim pots should be used in place of the filter resistors to adjust for best result and then replace by fix resistors.

a) FIG. 5*a* comprises of two op-amps 505 and 510. The total gain can be adjusted by the values of the resistor 504, 508 and 509 for optimal noise cancellation. Capacitor 500 is for AC coupling.

b) FIG. 5*b* using the basic two op-amps circuit as in FIG. 5*a* with the addition of a zero-pole compensation. Resistance of 508 is always higher than 531. The zero frequency is approximately $1/(2\pi RC)$ where R is resistance of 508 and C is capacitor 530. The first pole frequency is about $1/(2\pi RC)$ where R is resistor 531 and C is capacitor 530. The value of 530 and 531 is determined experimentally rather than using theory.

c) FIG. 5*c* also using the two op-amp circuit in FIG. 5*a* with the addition of poles-zero compensation. The resistance of 509 is higher than 541. The pole frequency is about $1/(2\pi RC)$ where R is resistance of 509, C is capacitor 540. The zero frequency is about $1/(2\pi RC)$ where R is resistor 541 and C is capacitor 540. These values are found experimentally rather than using theory.

d) FIG. 5*d* is another implementation, using three op-amps. This implementation is used for the Injection Amp shown in FIG. 4*b* where it is just an Impedance Means 452. First op-amp 505, resistors 501 and 504 are gain setting. The second stage is op-amp 560 with gain adjusted by resistors 574 and 572. Capacitor 570 is 10 uF bypass capacitor. Resistance of resistor 572 is higher than resistor 582. There is a zero-pole compensation. The zero frequency is about $1/(2\pi RC)$ where R is resistance of 572 and C is capacitor 584. Pole frequency is about $1/(2\pi RC)$ where R is resistance of 582 and C is capacitance of 584. The third gain stage is non inverting configuration using op-amp 562. The total gain should be evenly distributed between the three stages. This version was built and tested in one version of the Fifth Aspect of this Embodiment.

3) Injection Amp 304, 304A, 304B are just common transconductance type amplifiers. It is used to transform the output of Gain Phase Adjust circuit into a Current Signal. Three implementations are described below, other implementations using voltage to current converter or transconductance integrated circuit can also be used. One option is to design the Injection Amp with high output impedance to minimize the extra loading of the Signal Coil. Another option is to design the Injection Amp so the parallel combination of it's output impedance and the impedance of the Optimal Load, equals to the impedance of the Sound Control circuit suggested by the manufacturer of the Signal Coil.

a) FIG. 4*a* use a NPN transistor 402 in common base stage. The base of transistor 402 is biased at −V/2. The collector current is approximately |−V/2|−0.6 divided by the total resistance of resistors 404 and 408. Capacitor 401 is the AC coupling capacitor. This design has the highest output impedance over 10MΩ that is suitable for Signal Coils that require impedance of the Optimal Load to be 500KΩ or higher. The down side of this implementation is more complexity and require a DC blocking capacitor 308. Also, the output impedance of this implementation is not adjustable, it only depends on the transistor used. This circuit was built and tested as shown in FIG. 8*d*.

b) FIG. 4*b* is just an Impedance Means 452 with AC coupling capacitor 401. In FIG. 4*b*, the Impedance Means 452 is shown as a resistor, but it can be a single or plurality of passive components not limited to resistors, inductors and capacitors. 452 serves as a voltage to current converter to transform the output voltage of the Gain Phase Adjust to a Current Signal. 452 also raises the output impedance of the voltage amplifier to the value of device 452. Advantages of this implementation are it is simple and the impedance of 452 can be well controlled. You have the option to adjust the impedance so the impedance of 452 in parallel with the Optimal Load equals the Optimal Load suggested by the manufacturer of the Signal Coil. The disadvantage is you cannot make the impedance of 452 too high. The upper impedance limit of the device 452 is limited by the voltage swing capability of the voltage amplifier used for driving device 452. The higher the impedance of 452, the higher the voltage swing is needed to create the Current Signal. For single 9V battery power supply, the maximum value is about 5.1MΩ. On the lower limit, the output impedance should be at least 5 times the impedance of the Optimal Load. This will cause less than 17% decrease of the impedance loading of the Signal Coil. Anything lower will have noticeable affect on the sound characteristics. This version was successfully built and tested as in FIG. 8*e* using Fender Stratocaster. A 5.1MΩ resistor is used as 452, which is 40 time the impedance of the Optimal Load used in Fender Stratocaster type of Signal Coil.

c) FIG. 4*c* is the same idea as in FIG. 4*b* with extra op-amp 418 to increase gain.

4) 2 Coil Control 706 shown in FIG. 7*e* is similar to the control in Fender Telecaster. It comprises a 3 Way Switch 760 that select either input N or B, or the parallel combination of both inputs in the middle position before routing to output S. Output S of switch 760 drives the Optimal Load 332 at junction 326. The wiper of potentiometer 310 drives the output at 309.

5) 3 Coil Control 806 shown in FIG. 8*a* is similar as in Fender Stratocaster. It comprises a 5 Way Switch 830 that has two separate gangs but switching together. The first gang selects one of the N, M and B input or parallel combination of inputs and routes to output S. A first tone circuit comprises of potentiometer 834 in series with capacitor 836 connects to second gang's inputs NT and MT of switch 830. The second tone circuit comprises of potentiometer 837 in series with capacitor 838 connects to input BT of switch 830. Output S and ST of switch 830 connected together at junction 832. The first tone circuit controls the Signal Coils 300 and 300A. The second tone circuit controls Signal Coil 300B. The first Optimal Load is created when switch 830 selects input N alone, M alone, or N parallel with M. The first Optimal Load is the parallel combination of Potentiometer 310 and the first tone circuit. The second Optimal Load is created when switch 830 selects input B. The second Optimal Load is the parallel combination of Potentiometer 310 and the second tone circuit. The Transimpedance Load is form by the impedance of the Signal Coil and the Optimal Load selected.

6) Polarity Adjustment 701, is used to match the polarity of the Cancellation Coil to the Signal Coil. FIG. 7*f* is the inverted version and FIG. 7*g* is just a straight pass through.

Aspects of this Embodiment

Only a few aspects are shown using the pickup circuits of some of the most popular stringed instruments, as there can be many variations possible depending on the stringed instrument used. A battery circuit is only shown in FIG. 3*c* but not in any of the other drawings. Every aspect uses a battery circuit not limited to the one shown in FIG. 3*c*. In FIG. 3*c*, the negative end of the battery 350 connects to the −V of the Hum Cancellation Means. The positive end of the battery connects to the ground through switch S1 352 in the output jack 316. The battery 350 can be of different voltages, by choosing the correct op-amp, the circuit in this Embodiment can work with battery as low as 3V so a small size battery can be used. Capacitor 353 is a filter cap to stabilize the −V. Resistors 356 and 358 used were 75KΩ to produce half voltage named −V/2.

The basic theory of this Embodiment is described in detail in the First Aspect shown in FIG. 3*a*., FIG. 6*a* and FIG. 6*b*. The same theory applies to other aspects of this Embodiment with different Strings Sensing Means used in some popular stringed instruments.

1) The First Aspect of this Embodiment shown in the functional block diagram FIG. 3*a* is for stringed instrument with only one Signal Coil. The Strings Sensing Means 330 is the same as FIG. 1*a*. Wherein the String Sensing Means, a Signal Coil 300 produces the Signal and Noise Voltage, and a Optimal Load 332 to control the sound and for loading coil 300. The output of the Optimal Load 332 connects to the output jack 316. The forward signal path is from coil 300 at junction 306 through Optimal Load 332. Output of 332 connects to the Output Jack. The signal return path is from the ground of Output Jack 316, through junction 328 to junction 322, back to the return of the Signal Coil 300. The Hum Cancellation Means 340 comprises a Means of Noise Sensing; wherein, a Cancellation Coil 320 that senses only the unwanted electromagnetic radiation and produces a Cancellation Voltage. The Means of Noise Sensing also comprises a Gain Phase Adjust circuit 302 which is just amplifiers with optional low pass and high pass filters for adjusting the amplitude and phase of the Cancellation Voltage. A Transconductance Means named An Injection Amp 304 transforms the output of the Gain Phase Adjust 302 into a Current Signal and injects into the Signal Coil. The Current Signal is transformed by a Transimpedance Means back to a voltage equal and opposite to the Noise Voltage from coil 300; thereby, cancelling each other. The Transimpedance Means is the Signal Coil 300 in parallel with the Optimal Load 332 in the String Sensing Means. Two circuit implementations are described:

a) The first circuit implementation is shown in FIG. 6*a*. The Gain Phase Adjust 302 and Injection Amp 304 are implemented using circuit in FIG. 5*a* and FIG. 4*a* respectively. See description of functional block for FIG. 5*a* and FIG. 4*a* above. The Strings Sensing Means 330A is the same as 330 in FIG. 6*b* with the exception of an addition of capacitor 308. Current drawn by the transistor 402 creates a small offset voltage. Capacitor 308 is used to block the DC offset voltage from reaching the Output Jack 316.

b) Second circuit implementation of FIG. 3*a* is shown in FIG. 6*b*. Gain Phase Adjust 302 and Injection Amp 304 used are shown in FIG. 5*d* and FIG. 4*b* respectively. See description of functional block for FIG. 5*d* and FIG. 4*b* above. Resistor 451 in FIG. 6*b* is resistor 401 in FIG. 4*b*. Device 452 is just a simple resistor. See description of functional block of Injection Amp 304 in FIG. 4*b* on implementation.

2) The Second Aspect of this Embodiment is shown in FIG. 7*a*. The String Sensing Means used is represented by the pickup circuit in Fender Telecaster. The circuit implementation is shown in FIG. 7*d*. The Gain Phase Adjust and Injection Amp used are shown in FIG. 5*a* and FIG. 4*a* respectively. Wherein the Strings Sensing Means 752, a first and second Signal Coils 300 and 300A. Output of coil 300 and 300A at junction 705 and 705A, connect to N and B inputs respectively of the 2 Coil Control 706. See description functional block of 2 Coil Control 706 above. The output of 2 Coil Control 706 connects to the output jack 316 through capacitor 308 to block the DC offset. Wherein, the Hum Cancellation Means, the Cancellation Coil 320, the Gain Phase Adjust circuit 302 and the First Injection Amp 304 are same as shown in FIG. 3*a* and FIG. 6*a*, the alpha numerals are the same. The Gain Phase Adjust circuit 302 also drives a Polarity Adjustment circuit 701. Output of circuit 701 drives a second Injection Amps 304A through 703. Second Injection Amp 304A produces a second Current Signal for cancelling the Noise Voltage from coil 300A.

3) The Third Aspect of this Embodiment is shown in FIG. 7*b*. The Strings Sensing Means represents pickup circuit in some Gibson guitar with non-humbucking Signal Coils. Coil 300 and 300A connect to individual Optimal Load 332 and 332A respectively. Coil 300, driving the first Optimal Load 332 is the same as shown in FIG. 3*a*. The coil 300A drives the second Optimal Load 332A. The output of Optimal Loads 332 and 332A connect to N and B input of the 3 Way Switch 760. Output of 3 Way Switch 760 connects to the output jack 316. Hum Cancellation Means 750 is the same as in FIG. 7*a*, see description in the Second Aspect above.

4) The Fourth Aspect of this Embodiment is shown in FIG. 7*c*. The Strings Sensing Means is the same as the Second Aspect shown in FIG. 7*a*. The Hum Cancellation Means has a second Cancellation Coil 320A, driving a second Gain Phase Adjust 302A. The Second Gain Phase Adjust 302A drives a second Injection Amp 304A through 303A. The Injection Amp 304A generates the second Current Signal for coil 300A. Refer to description of FIG. 7*a* of the Second Aspect for details.

5) The Fifth Aspect of this Embodiment is shown in FIG. 8*b*. The Strings Sensing Means 842 represents the pickup circuit similar to Fender Stratocaster. The Strings Sensing Means 842 comprises of three Signal Coils 300, 300A and 300B, connect through junction 800, 800A and 800B, to inputs N, M and B of the 3 Coil Control 806 respectively. See description of functional block 3 Coil Control 806 on how the first and second Optimal Load and the Transimpedance Means are formed. The Hum Cancellation Means used is shown in FIG. 8*b*. The Cancellation Coil 320, Gain Phase Adjust 302, Injection Amp 304 and 304A are the same as the Hum Cancellation Means 750 in FIG. 7*a*. The Gain Phase Adjust 302 drives a third Injection Amp 304B through 801. See description in Second Aspect above for details. The third Injection Amp 304B generates the third Current Signal for cancelling the Noise Voltage in the coil 300B. Two circuits shown in FIG. 8*d* and FIG. 8*e*, were successfully built and tested as described below:

a) The first circuit implementation is shown in FIG. 8*d*. The output of 3 Coil Control 806 connects to the Jack 316 through capacitor 308. See 3 Coil Control 806 description for detail. Wherein the Hum Cancellation Means, the coil 320, Gain Phase Adjust circuit 302, Injection Amp 304 and 304A and Polarity Control 701 are the same as shown in FIG. 7*d*. A third Injection Amp 304B converts the output of the Gain Phase Adjust 302 into a third Current Signal. The third Injection Amp 304B injects the third Current Signal into the coil 300B for noise cancellation. The version of Gain Phase Adjust circuit and Injection Amp used are shown in FIG. 5*a* and FIG. 4*a* respectively. The values of resistor 501, 504, 508 and 509 were 2KΩ, 20KΩ, 2KΩ and 9.5KΩ respectively. Resistor 404/404A/404B and 408/408A/408B were 100KΩ and 220KΩ respectively. Capacitor 401 is 4.7 uF. The transistors 402, 402A and 402B were MPSA18. Different resistor values or transistor can be used.

b) The second circuit implementation of the Fifth Aspect is shown in FIG. 8*e*. The Strings Sensing Means is as described in the first circuit implementation, but without the capacitor 308. The Gain Phase Adjust circuit and Injection Amp are shown in FIG. 5*d* and FIG. 4*b* respectively. Resistor 451 in FIG. 8*e* is resistor 401 in FIG. 4*b*. Device 452 is just a simple resistor. Resistor 501, 572, 582 were 200 Ω, 4.99KΩ and 2KΩ respectively. Resistor 504, 574 and 579 were 39KΩ. Capacitor 570, 584 were 10 uF and 820 pF respectively. A 10KΩ potentiometer was used in place of resistor 578 to adjust for best noise cancellation, then replaced with a fixed resistor of same value. Referring to FIG. 4*b*, the Impedance Means 452 is a resistor of 5.1MΩ with a 0.1 uF AC coupling capacitor 451. See description for FIG. 5*d* and FIG. 4*b* for details. It is important to note the value of resistor 582 and 578 are only for the specific Cancellation Coil and Signal Coil used. For other coils, these resistors are first replaced by trim pots, adjusted for best noise cancellation, then replace by fix resistors of the adjusted values. The capacitor 584 should also be determined experimentally to get the best result starting with the values given here. These are all done by trial and error.

6) The Sixth Aspect of this Embodiment is shown in FIG. 8*c*. The Strings Sensing Means is the same as in the Fifth Aspect shown in FIG. 8*b*. The Hum Cancellation Means 844 is the same as the Forth aspect of this Embodiment shown in FIG. 7*c* with an addition of a third Cancellation Coil 320B driving a third Gain Phase Adjust 302B. Circuit 302B drives a third Injection Amp 304B through 303B. The third Injection Amp 304B injects a third Current Signal into coil 300B for noise cancellation. See description of the Fourth Aspect for details.

Another way of implementing this embodiment is a complete pickup system including the Strings Sensing Means. The advantage is, the Hum Cancellation Means can be optimized to the specific Signal Coils used in order to get better noise cancellation.

CONCLUSION

Tests were done with two implementations shown in FIG. 8*d* and FIG. 8*e*, using a Fender Stratocaster. The original pickup circuit of the Stratocaster was used as the String Sensing Means. A switch was installed to disconnect the outputs of the Injection Amps 304, 304A and 304B from junctions 800, 800A and 800B respectively. It was shown that there is no difference in the sound characteristics whether the Injection Amps were connected to the Signal Coils or not. The only difference was that there was no noise cancellation when the Injection Amps were disconnected. Also, test were done by turning the power on and off to proof that there was no difference in the sound characteristics. The only difference is there was no noise cancellation when the power was off.

I claim:

1. A noise cancellation system for existing electric stringed instruments comprises of a pickup circuit with a single or plurality of pickup coils named signal coils; each of the said signal coil not only senses the vibrating strings, it also senses unwanted electromagnetic radiation; thereby, each produces a noise voltage that causes humming and buzzing noise when connected to an amplifier; the said noise cancellation system together with the said pickup circuit comprising:

a means of noise sensing that senses only the said unwanted electromagnetic radiation; and one or more transconductance means with high output impedance, each transforms the output of the said means of noise sensing into a current signal; said transconductance means injects the said current signal directly into one of the said signal coil; high output impedance of the said transconductance means allows direct connection to the said signal coil with negligible affect on the total impedance loading the said signal coil; whereby, preserving the sound characteristics of the said existing stringed instrument;

one or more transimpedance means, each comprises one of the said signal coil in parallel with the impedance of the circuit loading the said signal coil in the said existing stringed instrument; each of the said transimpedance means transforms one of the said current signal back to a voltage equal and opposite to the said noise voltage from the said signal coil; whereby, canceling each other and eliminating the noise.

2. The noise cancellation system in claim 1, said transconductance means is designed with output impedance over 5 times the impedance already loading the said signal coil in the existing pickup circuit, said transconductance means maintains high output impedance without electric power.

3. The noise cancellation system in claim 1, said means of noise sensing comprises a single or plurality of coils called cancellation coils for sensing the said unwanted electromagnetic radiation.

4. The noise cancellation system in claim 1, said transconductance means is implemented with either:

a) a transistor as a voltage to current converter;

b) an impedance means driven by an amplifier with low output impedance; said impedance means raises the output impedance of the said amplifier, and also convert the output voltage of the said amplifier to the said current signal to simulate a transconductance amplifier, or;

c) a voltage controlled current source or transconductance type of integrated circuit.

5. A pickup system with noise cancelling for stringed musical instruments; said pickup system comprises:

a strings sensing means; wherein a single or plurality of pickup coils named signal coils, each of the said signal coil responses to the vibrating strings and the unwanted electromagnetic radiation; thereby, each produces a signal voltage from the strings, and a noise voltage from the said radiation; a means of noise sensing that senses only the said unwanted electromagnetic radiation; and one or more transconductance means, each transforms the output of the said means of noise sensing into a current signal; said transconductance means injects the said current signal directly into one of the said signal coil;

one or more transimpedance means, each comprises one of the said signal coil in parallel with the impedance of the circuit loading the said signal coil in the said strings sensing means; each of the said transimpedance means transforms one of the said current signal back to a voltage equal and opposite to the said noise voltage from the said signal coil; whereby, canceling each other and eliminating the noise.

6. The pickup system in claim 5, said transconductance means is designed with output impedance over 5 times the impedance already loading the said signal coil in the pickup circuit, said transconductance means maintains high output impedance without electric power.

7. The pickup system in claim 5, said transconductance means is designed so the output impedance of the circuit in parallel with the impedance of the circuit already loading the said signal coil, equals the impedance of the sound control circuit suggested by the manufacturer of the said signal coil.

8. The pickup system in claim 5, said means of noise sensing comprises a single or plurality of coils called cancellation coils for sensing the said unwanted electromagnetic radiation.

9. The pickup system in claim 5, said transconductance means is implemented either with: a) a transistor as a voltage to current converter;

b) an impedance means driven by an amplifier with low output impedance; said impedance means raises the output impedance of the said amplifier, and also convert the output voltage of the said amplifier to the said current signal to simulate a transconductance amplifier;

c) a voltage controlled current source or transconductance type of integrated circuit.

10. A method of noise cancelling for electric stringed musical instruments comprise of pickup circuit with a single or plurality of pickup coils named signal coils; said signal coils response to the vibrating strings and the unwanted electromagnetic radiation; whereby, each produces a noise voltage that causes humming and buzzing noise when connected to an amplifier; the method of noise cancellation comprising the steps of:

(a) sensing the said unwanted electromagnetic radiation by a means of noise sensing; then (b) transforming the output of the said means of noise sensing into a single or plurality of current signals, each by a transconductance means;

(c) injecting each of the said current signal directly into one of the said pickup coil by the said transconductance means;

(d) transforming each of the said current signal back to a voltage across the said pickup coil that is equal and opposite to the said noise voltage produced by the said signal coil; whereby, cancelling the said noise voltage and eliminates the noise.

11. The method of claim 10, said transconductance means is designed with output impedance over 5 times the impedance already loading the said signal coil in the said pickup circuit, said transconductance means maintains high output impedance without electric power.

12. The method of claim 10, said transconductance means is designed so the output impedance of the circuit in parallel with the impedance of the circuit already loading the said signal coil, equals the impedance of the sound control circuit suggested by the manufacturer of the said signal coil.

13. The method of claim 10, said current signal is transformed into a voltage by the impedance of the said signal coil in parallel with the impedance of the circuit loading the said signal coil inside the said pickup circuit.

14. The method of claim 10, said means of noise sensing comprises a single or plurality of coils called cancellation coils for sensing the unwanted electromagnetic radiation.

15. The method of claim 10, said means of noise sensing comprises of high pass and low pass filters for gain and phase compensation.

16. The system of claim 1, said means of noise sensing comprises of high pass and low pass filters for gain and phase compensation.

17. The system of claim 5, said means of noise sensing comprises of high pass and low pass filters for gain and phase compensation.

* * * * *